United States Patent [19]

Nakamura et al.

[11] 4,176,635

[45] Dec. 4, 1979

[54] EXHAUST GAS RECIRCULATION SYSTEM FOR AN INTERNAL COMBUSTION ENGINE

[75] Inventors: Norihiko Nakamura, Mishima; Noboru Toyama; Toyokazu Baika, both of Susono, all of Japan

[73] Assignee: Toyota Jidosha Kogyo Kabushiki Kaisha, Toyota, Japan

[21] Appl. No.: 897,870

[22] Filed: Apr. 19, 1978

[30] Foreign Application Priority Data

Dec. 29, 1977 [JP] Japan ..... 52-159303

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,931,813 | 1/1976 | Horie et al. | 123/119 A |
| 4,031,871 | 6/1977 | Hamanishi | 123/119 A |
| 4,041,917 | 8/1977 | Suzuki | 123/119 A |
| 4,056,084 | 11/1977 | Baumgartner | 123/119 A |
| 4,069,797 | 1/1978 | Nohira et al. | 123/119 A |
| 4,092,960 | 6/1978 | Nohira et al. | 123/119 A |
| 4,128,089 | 12/1978 | Tarimoto et al. | 123/119 A |
| 4,137,874 | 2/1979 | Otsubo et al. | 123/119 A |

*Primary Examiner*—Wendell E. Burns

*Attorney, Agent, or Firm*—Stevens, Davis, Miller & Mosher

[57] ABSTRACT

An exhaust gas recirculation system for an internal combustion engine of the back pressure control type wherein a back pressure chamber formed in a recirculation passage for recirculating exhaust gases is controlled to be substantially at atmospheric pressure by co-operation of a vacuum-operated diaphragm type exhaust gas recirculation control valve and a vacuum control valve which modifies the vacuum supplied to the exhaust gas recirculation control valve, wherein the system further includes a vacuum switching valve which selectively supplies intake manifold vacuum to a second diaphragm chamber of the exhaust gas recirculation control valve so as to close the control valve temporarily when the engine is decelerated.

2 Claims, 1 Drawing Figure

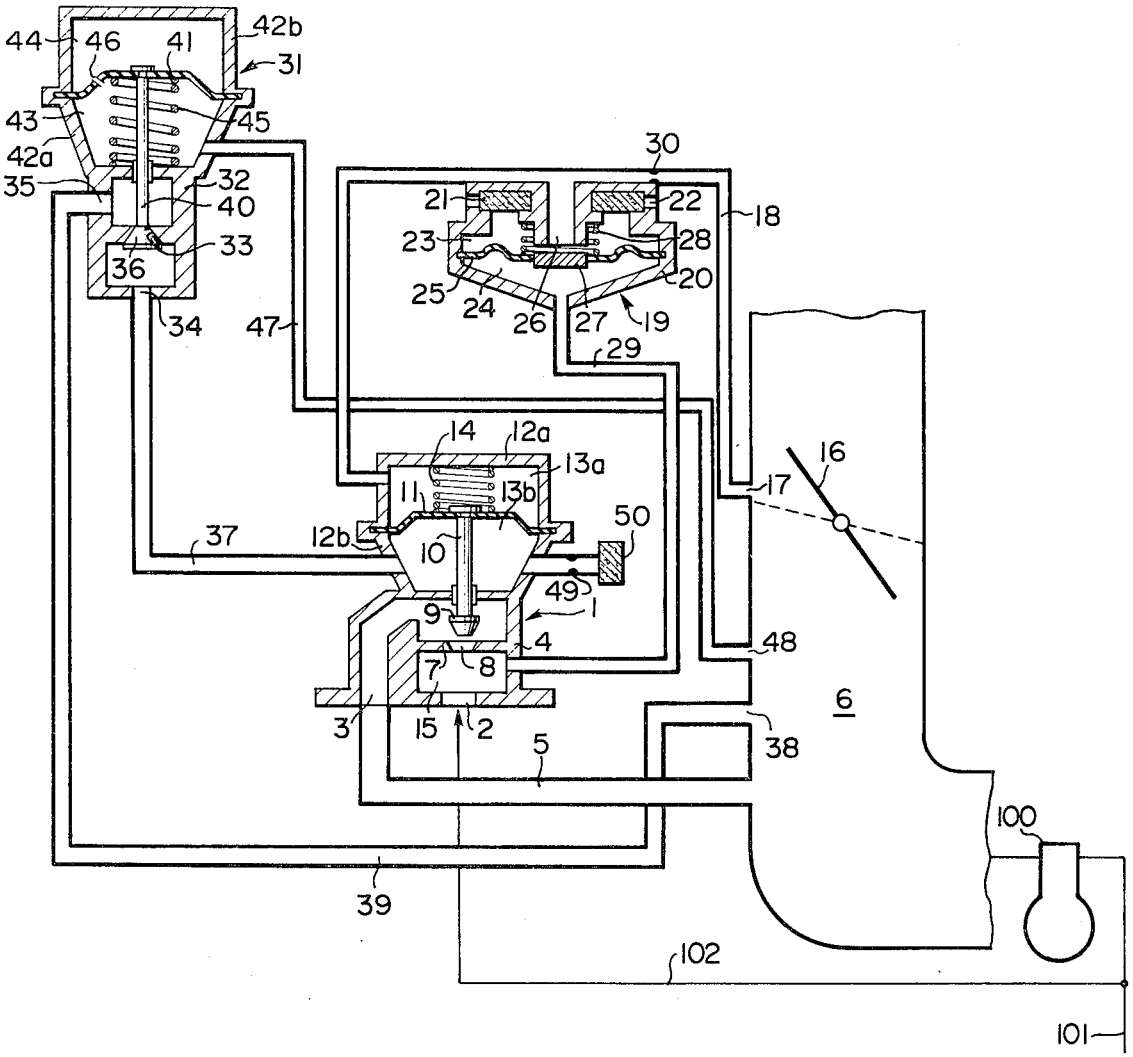
44
46
41
42b
31
43
45
42a
35
32
40
33
36
34
47
30
21
22
18
23
28
20
25
24
26
27
19
29
14
12a
13a
11
13b
16
17
50
37
12b
10
49
1
9
4
48
7
8
6
3
15
2
5
38
100
39
102
101

EXHAUST GAS RECIRCULATION SYSTEM FOR AN INTERNAL COMBUSTION ENGINE

BACKGROUND OF THE INVENTION

The present invention relates to an exhaust gas recirculation system for an internal combustion engine for a vehicle such as an automobile, and, more particularly, to an exhaust gas recirculation system of the back pressure control type.

An exhaust gas recirculation system of the back pressure type, which is known as a system of exhaust gas recirculation for an internal combustion engine, generally comprises an exhaust gas recirculation control valve provided at a middle portion of a recirculation passage which recirculates a part of exhaust gases from the exhaust passage to the intake passage of an engine, said control valve having a diaphragm chamber and being adapted to increase its opening in accordance with increase of vacuum supplied to said diaphragm chamber, a vacuum port provided in the intake passage so as to be located upstream of a throttle valve incorporated in the intake passage when it is fully closed and so as to be located downstream of said throttle valve when it is opened beyond a predetermined opening, and a vacuum control valve provided at a middle portion of a vacuum passage which connects said vacuum port and said diaphragm chamber of said exhaust gas recirculation control valve and being adapted to control the vacuum conducted through said vacuum passage in accordance with the pressure of exhaust gases in the recirculation passage, wherein the exhaust gas recirculation control valve is operated by the vacuum which is supplied from said vacuum port and controlled by said vacuum control valve in accordance with the pressure of exhaust gases in the recirculation passage so that the exhaust gas recirculation ratio, i.e. the ratio of flow of exhaust gases to that of intake air, is maintained substantially at a constant value over a wide range of operation of the engine.

However, in the conventional exhaust gas recirculation system of the back pressure type having the above-mentioned structure, since the exhaust gas recirculation control valve is operated by the vacuum controlled in accordance with the pressure of exhaust gases in the recirculation passage, there occurs a time delay from the instant when the flow of intake air is changed to the instant when the exhaust gas recirculation control valve is operated to meet with the change of intake air flow due to the time required for engine intake air to flow through the cylinders of the engine. Furthermore, a delay in the response of the exhaust gas recirculation control valve is also caused by the throttling means provided in the vacuum passage for conducting vacuum from the vacuum port to the diaphragm chamber of the exhaust gas recirculation control valve and the throttling means provided in the recirculation passage for conducting exhaust gases from an exhaust gas takeout port provided in the exhaust passage to a back pressure chamber located upstream of the exhaust gas recirculation control valve. Therefore, in transient operational conditions such as acceleration or deceleration, changes of flow of exhaust gases are effected with a substantial delay relative to changes of flow of intake air. Such a delay in response causes no serious problem in acceleration, whereas in deceleration, particularly in abrupt deceleration, it causes a serious problem in that when the flow of intake air has already been decreased, a high exhaust gas pressure still exists in the back pressure chamber, whereby the vacuum control valve is maintained in such an operating condition as to hold a high vacuum in the vacuum passage for the diaphragm chamber of the exhaust gas recirculation control valve, while such a high vacuum in the vacuum passage is not immediately relieved through the vacuum port now located upstream of the fully closed throttle valve due to the throttling means provided at a middle portion of the vacuum passage. Therefore, in abrupt deceleration, a large amount of exhaust gases is recirculated to a very small amount of intake air, thereby causing misfiring of the internal combustion engine. Furthermore, when the exhaust gas recirculation control valve has been throttled to meet with the reduction of intake air flow after a time of delay in response, the engine is then abruptly restored to its normal operation, thereby causing forward jerking of the vehicle, which makes it less controllable. These problems become more serious, the higher is the exhaust gas recirculation ratio.

SUMMARY OF THE INVENTION

The object of the present invention is to obviate the aforementioned problems and to provide an improved exhaust gas recirculation system of the back pressure type wherein exhaust gas recirculation is immediately stopped when operation of the engine is altered to the decelerating mode.

In accordance with the present invention, the above-mentioned object is accomplished by an exhaust gas recirculation system for an internal combustion engine having an intake passage incorporating a throttle valve therein and an exhaust passage, comprising a recirculation passage for recirculating exhaust gases from said exhaust passage to said intake passage, an exhaust gas recirculation control valve provided at a middle portion of said recirculation passage, said control valve having first and second diaphragm chambers and being adapted to increase its opening in accordance with increase of vacuum supplied to said first diaphragm chamber and to decrease its opening in accordance with increase of vacuum supplied to said second diaphragm chamber, a vacuum port provided in said intake passage so as to be located upstream of said throttle valve when it is fully closed and so as to be located downstream of said throttle valve when it is opened beyond a predetermined opening, a first vacuum passage which connects said vacuum port and said first diaphagm chamber of said exhaust gas recirculation control valve, a vacuum control valve provided at a middle portion of said vacuum passage and adapted to control the vacuum conducted through said vacuum passage in accordance with the pressure of exhaust gases in said recirculation passage, a second vacuum passage which connects said second diaphragm chamber of said exhaust gas recirculation control valve and said intake passage, and a vacuum switching valve which normally intercepts said second vacuum passage and selectively opens said second vacuum passage, said vacuum switching valve having a valve port, a diaphragm means including first and second diaphragm chambers controlling said valve port, and a throttling passage which connects said first and second diaphragm chambers of said vacuum switching valve, said first diaphragm chamber of said vacuum switching valve being supplied with intake vacuum of the engine, wherein said diaphragm means opens said valve port when the vacuum in said first diaphragm chamber of said vacuum switching valve is greater than that in said second diaphragm chamber of said vacuum switching valve by more than a predetermined difference.

In the exhaust gas recirculation system of the above-mentioned structure, when the engine is abruptly decelerated with the intake passage being abruptly throttled by the throttle valve, the vacuum in said first diaphragm chamber of said vacuum switching valve becomes greater than that in said second diaphragm chamber of said vacuum switching valve by more than the predetermined difference so as to actuate said diaphragm means of said vacuum switching valve to open said valve port, whereby said second diaphragm chamber of said exhaust gas recirculation control valve is supplied with intake vacuum so that said exhaust gas recirculation control valve decreases its opening so far as completely to close it, thereby immediately shutting down exhaust gas recirculation.

Furthermore, when said second diaphragm chamber of said exhaust gas recirculation control valve is connected to the intake passage of the engine with said valve port of said vacuum switching valve being opened during deceleration of the engine, atmospheric air is drawn into said second diaphragm chamber of said exhaust gas recirculation control valve through said throttled opening, said air being further conducted through said second vacuum passage and finally drawn into the intake passage of the engine so that an effect of mixture control, i.e. to dilute intake mixture in deceleration in order to suppress emission of harmful uncombusted components, is obtained. On the other hand, when the present invention is embodied in an internal combustion engine having a mixture control means which dilutes intake mixture during deceleration, it will be possible to utilize the mixture control means as the vacuum switching valve incorporated in the present invention.

BRIEF DESCRIPTION OF THE DRAWING

The present invention will become more fully understood from the detailed description given hereinbelow and the accompanying drawing which is given by way of illustration only, and thus is not limitative of the present invention, and wherein the sole FIGURE is a diagrammatical view showing an embodiment of the exhaust gas recirculation system of the present invention.

DESCRIPTION OF THE PREFERRED EMBODIMENT

Referring to the drawing, 1 designates an exhaust gas recirculation control valve having a valve housing 4 which defines an inlet port 2 connected with the exhaust passage 101 of an internal combustion engine 100 by way of a passage 102 and an outlet port 3 connected with the intake passage 6 of the engine by way of a passage 5. The passages 102 and 5 form a recirculation passage for recirculating exhaust gases from the exhaust passage 101 to the intake passage 6. Between the inlet port 2 and the outlet port 3 is defined a valve port 8 by a valve seat 7. The opening of the valve port 8 is controlled by a valve element 9 which co-operates with the valve seat 7. The valve element 9 is supported by a valve stem 10 which is connected with a diaphragm 11. On one side, the upper side in the FIGURE, of the diaphragm is defined a first diaphragm chamber **13*a* by the co-operation of the diaphragm 11 and a diaphragm cover portion 12*a*, while on the other side, the lower side as seen in the FIGURE, of the diaphragm is defined a second diaphragm chamber 13*a* by co-operation of the diaphragm 11 and a diaphragm base portion 12*b*. The diaphragm 11 is urged downward in the FIGURE, i.e. in the direction to close the valve port 8 by the valve element 9, by a compression coil spring 14 provided in the diaphragm chamber 13*a*. The diaphragm chamber 13*a* is connected to a vacuum port 17 by a vacuum passage 18, said vacuum port being provided in the intake passage 6 so as to be located upstream of a throttle valve 16** incorporated in the intake passage when the throttle valve is fully closed and so as to be located downstream of the throttle valve when it is opened beyond a predetermined opening.

At a middle portion of the vacuum passage 18 is provided a vacuum control valve 19 which is adapted to control the vacuum conducted through the vacuum passage 18. The vacuum control valve 19 has a housing 20 which defines a diaphragm chamber 24 therein in co-operation with a diaphragm 25 and a valve port 26 connected with the vacuum passage 18 and adapted to be controlled by a valve element 27 supported by the diaphragm 25. The diaphragm 25 is urged downward in the FIGURE by a compression coil spring 28. The diaphragm chamber 24 is connected with a back pressure chamber 15 provided in the exhaust gas recirculation control valve 1 by way of a passage 29. When the diaphragm chamber 24 is at atmospheric pressure, the diaphragm 25 is shifted downward by the compression coil spring 28 so as to open the port 26, as shown in the FIGURE, whereby the vacuum passage 18 is opened to the atmosphere at a middle portion thereof through the port 26, a relief chamber 23, an air filter 21 and relief openings 22. On the other hand, when the pressure in the diaphragm chamber 24 rises beyond atmospheric pressure, the diaphragm 25 is shifted upward as seen in the FIGURE so as to close the port 26 by the valve element 27 thereby isolating the vacuum passage 18 from the atmosphere. The pressure in the diaphragm chamber 24 reflects the pressure of exhaust gases in the back pressure chamber 15. A throttling element 30 is provided between the vacuum port 17 and the vacuum control valve 19.

The second diaphragm chamber **13*b* of the exhaust gas recirculation control valve 1 is selectively supplied with intake vacuum of the engine under the control of a vacuum switching valve 31. The vacuum switching valve has a housing 32 which defines a valve port 33 provided between connection ports 34 and 35 and controlled by a valve element 36. The connection port 34 is connected with the diaphragm chamber 13*b* of the exhaust gas recirculation control valve 1, while on the other hand the connection port 35 is connected with a vacuum port 38 provided at the intake passage 6 by way of a passage 39. The valve element 36 is supported by a valve stem 40 which is connected with a diaphragm 41. On one side of the diaphragm 41 is defined a first diaphragm chamber 43 by co-operation of the diaphragm and a base portion 42*a* of the valve housing, while on the other side of the diaphragm is defined a second diaphragm chamber 44 by co-operation of the diaphragm and a cover portion 42*b* of the valve housing. The diaphragm 41 is urged upward in the FIGURE by a compression coil spring 45 so that the valve element 36 normally closes the valve port 33. The first and second diaphragm chambers 43 and 44 are connected with each other through a throttled opening 46 formed in the diaphragm 41. The first diaphragm chamber 43 is connected with a vacuum port 48 provided in the intake passage 6 by means of a passage 47 so as to be supplied with intake vacuum of the engine. The vacuum port 48 and the aforementioned vacuum port 38 are both located downstream of the throttle valve regardless of to what extent it is open. The diaphragm 41 of the vacuum switching valve 31 is shifted downward in the FIGURE when the vacuum in the first diaphragm chamber 43 is greater than that in said second diaphragm chamber 44 by more than a predetermined difference so as to open the valve port 33. In other operating conditions the valve port 33 is normally closed by the valve element 36 due to the action of the compression coil spring 45. When the valve port 33 is opened, the diaphragm chamber 13*b* of the exhaust gas recirculation control valve 1 is connected with the vacuum port 38 and is supplied with intake vacuum of the engine. The diaphragm chamber 13*b* is opened to the atmosphere through a throttling means 49 and an air filter 50. Therefore, when the diaphragm chamber 13*b* is connected with the vacuum port 38, the diaphragm 11 is immediately shifted downward in the FIGURE, while atmospheric air is drawn into the diaphragm chamber 13*b* through the throttling means 49 thereby somewhat reducing the vacuum in the diaphragm chamber 13*b*, and when the valve port 33 of the vacuum switching valve 31 is closed, the vacuum in the diaphragm chamber 13*b* soon disappears due to the introduction of air through the throttling means 49**.

The exhaust gas recirculation system explained above operates as follows.

When the throttle valve 16 is not opened so much as to traverse the vacuum port 17, as in idling operation, the vacuum port 17 is supplied with atmospheric pressure. In this condition, the exhaust gas recirculation control valve 1 is in the closed condition wherein exhaust gas recirculation is shut down. When the throttle valve 16 is opened beyond the valve port 17 as shown by the solid line in the FIGURE, the vacuum port 17 is supplied with a substantial intake vacuum which is conducted through the vacuum passage 18 and is supplied to the diaphragm chamber **13*a* of the exhaust gas recirculation control valve 1, whereby the diaphragm 11 is shifted upward in the FIGURE so as to open the port 8 whereby exhaust gas recirculation is performed. In this case, if the pressure of exhaust gases in the back pressure chamber 15 is lower than the atmospheric pressure, the pressure in the diaphragm chamber 24 of the vacuum control valve 19 is correspondingly low so that the valve element 27 opens the valve port 26 so as to allow atmospheric air to flow into the vacuum passage 18 at a middle portion thereof, thereby reducing the vacuum supplied to the diaphragm chamber 13*a* of the exhaust gas recirculation control valve 1, whereby the opening of the port 8 is reduced and the pressure in the back pressure chamber 15 rises. This pressure rise in the back pressure chamber 15 is reflected as a corresponding pressure rise in the diaphragm chamber 24 in the vacuum control valve 19 in a manner such that when the pressure in the diaphragm chamber 24 is higher than atmospheric pressure, the valve element 27 closes the valve port 26 so as to prevent atmospheric air from flowing into the vacuum passage 18. Then the vacuum supplied to the diaphragm chamber 13*a* of the exhaust gas recirculation control valve 1 is increased, whereby the diaphragm 11 is shifted upward so as to increase the opening of the port 8, thereby reducing the pressure in the back pressure chamber 15. By the feedback control of the aformentioned manner, the pressure in the back pressure chamber 15 is maintained substantially at atmospheric pressure. Therefore, when the opening of the port 2 is properly determined, the ratio of exhaust gas recirculation through the recirculation passage 102** is maintained substantially at a predetermined constant value regardless of changes of the flow of exhaust gases or output power of the engine.

During steady operation of the engine, the intake vacuum monitored by the vacuum port 48 is transmitted to the diaphragm chamber 43 of the vacuum switching valve 31 and the same vacuum is also transmitted to the diaphragm chamber 44 of the vacuum switching valve. In acceleration of the engine the intake vacuum monitored by the vacuum port 48 changes so as to decrease. Therefore, during steady operation and acceleration of the engine, the port 33 of the vacuum switching valve 31 is closed by the valve element 36 which is driven upward by the compression coil spring 41. In this condition, therefore, the diaphragm chamber **13*b* of the exhaust gas recirculation control valve 1** is dominated by atmospheric pressure.

When the engine is abruptly decelerated by abrupt throttling of the throttle valve 16, the vacuum port 48 is supplied with a high intake vacuum which is immediately transmitted to the diaphragm chamber 43 of the vacuum switching valve 31, whereas the transmission of the increased vacuum to the diaphragm chamber 44 through the throttled opening 46 is somewhat delayed. Therefore, immediately after abrupt deceleration, the diaphragm 41 of the vacuum switching valve is shifted downward in the FIGURE so as to open the port 33, so that the diaphragm chamber **13*b* of the exhaust gas recirculation control valve 1 is connected to the vacuum port 38. Therefore, the diaphragm 11 of the exhaust gas recirculation control valve is shifted downard in the FIGURE so as to throttle or close the port 8 thereby reducing the rate of exhaust gas recirculation or completely shutting down exhaust gas recirculation. By this operation, over-recirculation of exhaust gases such as suffered in a conventional exhaust gas recirculation system during and/or immediately after deceleration of the engine is effectively avoided. Furthermore, by the establishment of an air intake passage including the air filter 50, the throttling means 49 and the passages 37 and 39, and having proper flow resistance, additional intake air is supplied to the intake passage 6** so as to compensate for over-enrichment of mixture caused by abrupt throttling of the intake passage in deceleration, whereby mis-firing of the engine due to over-enrichment of mixture in abrupt deceleration is also avoided.

After the lapse of a proper time determined by the throttled opening 46, the vacuum levels in the diaphragm chambers 43 and 44 of the vacuum switching valve 31 reach equilibrium, whereby the diaphragm 41 is restored to its normal position of closing the port 33 and of isolating the diaphragm chamber **13*b* of the exhaust gas recirculation control valve 1 from the vacuum port 38. Thereafter, the normal feedback control of exhaust gas recirculation by the co-operation of the exhaust gas recirculation control valve and the vacuum control valve 19** is resumed.

From the foregoing it wil be appreciated that the exhaust gas recirculation system of the present invention obviates the delay in response with regard to changes of recirculation flow of exhaust gases relative to changes of intake air flow in abrupt deceleration of the engine in the exhaust gas recirculation system of the back pressure control type by the temporary shutting down of the exhaust gas recirculation control valve due to direct control by intake manifold vacuum.

Although the invention has been shown and described with respect to a preferred embodiment thereof, it should be understood by those skilled in the art that various changes and omissions of the form and detail thereof may be made therein without departing from the scope of the invention.

We claim:

1. An exhaust gas recirculation system for an internal combustion engine having an intake passage incorporating a throttle valve therein and an exhaust passage, comprising a recirculation passage for recirculating exhaust gases from said exhaust passage to said intake passage, an exhaust gas recirculation control valve provided at a middle portion of said recirculation passage, said control valve having first and second diaphragm chambers and a throttled opening which opens said second diaphragm chamber to the atmosphere and being adapted to increase its opening in accordance with increase of vacuum supplied to said first diaphragm chamber and to decrease its opening in accordance with increase of vacuum supplied to said second diaphragm chamber, a vacuum port provided in said intake passage so as to be located upstream of said throttle valve when it is fully closed and so as to be located downstream of said throttle valve when it is opened beyond a predetermined opening, a first vacuum passage which connects said vacuum port and said first diaphragm chamber of said exhaust gas recirculation control valve, a vacuum control valve provided at a middle portion of said vacuum passage and adapted to control the vacuum conducted through said vacuum passage in accordance with the pressure of exhaust gases in said recirculation passage, a second vacuum passage which connects said second diaphragm chamber of said exhaust gas recirculation control valve and said intake passage, and a vacuum switching valve which normally intercepts said second vacuum passage and selectively opens said second vacuum passage, said vacuum switching valve having a valve port, a diaphragm means including first and second diaphragm chambers controlling said valve port, and a throttling passage which connects said first and second diaphragm chambers of said vacuum switching valve, said first diaphragm chamber of said vacuum switching valve being supplied with intake vacuum of the engine, wherein said diaphragm means opens said valve port when the vacuum in said first diaphragm chamber of said vacuum switching valve is greater than that in said second diaphragm chamber of said vacuum switching valve by more than a predetermined difference.

2. The exhaust gas recirculation system of claim 1, wherein said vacuum switching valve has a diaphragm which separates said first and second diaphragm chambers of said vacuum switching valve, a valve element connected with said diaphragm and controlling said valve port, and a spring which urges said diaphragm and said valve element in the direction to close said valve port by said valve element, said throttling passage which connects said first and second diaphragm chambers of said vacuum switching valve being formed in said diaphragm.

* * * * *